US008755551B2

(12) United States Patent
Ritter et al.

(10) Patent No.: US 8,755,551 B2
(45) Date of Patent: Jun. 17, 2014

(54) HEARING APPARATUS HAVING A SPECIAL SOUND CHANNEL

(75) Inventors: Hartmut Ritter, Neunkirchen am Brand (DE); Michael Sattler, Bubenreuth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/561,544

(22) Filed: Jul. 30, 2012

(65) Prior Publication Data

US 2013/0028455 A1 Jan. 31, 2013

(30) Foreign Application Priority Data

Jul. 29, 2011 (DE) ..... 10 2011 080 123

(51) Int. Cl.
*H04R 25/00* (2006.01)

(52) U.S. Cl.
USPC ..... 381/330; 381/322; 381/382

(58) Field of Classification Search
USPC ..... 381/322, 324, 328, 330, 338, 380, 381, 381/382; 181/128, 129
See application file for complete search history.

(56) References Cited

U.S. PATENT DOCUMENTS

| | | | | |
|---|---|---|---|---|
| 6,658,125 | B1 * | 12/2003 | Batting | 381/330 |
| 6,735,319 | B1 * | 5/2004 | Vonlanthen | 381/330 |
| 7,715,580 | B2 * | 5/2010 | Nielsen | 381/322 |
| 2003/0198361 | A1 | 10/2003 | Heerlein et al. | |
| 2005/0020127 | A1 | 1/2005 | Fickweiler et al. | |
| 2008/0095390 | A1 | 4/2008 | Gebert et al. | |
| 2008/0205680 | A1 | 8/2008 | Ho et al. | |

FOREIGN PATENT DOCUMENTS

| | | | |
|---|---|---|---|
| DE | 4327634 | C1 | 6/1994 |
| DE | 10214189 | A1 | 10/2003 |
| EP | 1915032 | A2 | 4/2008 |
| EP | 1962555 | A2 | 8/2008 |
| JP | 8251698 | A | 9/1996 |

* cited by examiner

*Primary Examiner* — Huyen D Le
(74) *Attorney, Agent, or Firm* — Laurence A. Greenberg; Werner H. Stemer; Ralph E. Locher

(57) ABSTRACT

A hearing apparatus has a housing, a receiver in the housing, and a sound conductor through which sound from the receiver is conducted out of the housing. In order to render the device as small as possible, the hearing apparatus has a cover piece which is inserted into the housing in such a way that a sound channel is formed. The sound channel is thereby delimited at the sides by the housing and the cover piece. A special sound-conducting tube can therefore be dispensed with.

9 Claims, 3 Drawing Sheets

HEARING APPARATUS HAVING A SPECIAL SOUND CHANNEL

CROSS-REFERENCE TO RELATED APPLICATION

This application claims the priority, under 35 U.S.C. §119, of German patent application DE 10 2011 080 123.5, filed Jul. 29, 2011; the prior application is herewith incorporated by reference in its entirety.

BACKGROUND OF THE INVENTION

Field of the Invention

The present invention relates to a hearing apparatus having a housing, a receiver which is arranged in the housing, and a sound conductor through which sound from the receiver is conducted out of the housing. The term "hearing apparatus" is understood here to mean any sound-emitting device that can be worn in or on the ear, in particular a hearing device, a headset, headphones and the like.

Hearing devices are wearable hearing apparatuses which are used to provide hearing assistance to the hard-of-hearing. In order to accommodate the numerous individual requirements, various designs of hearing devices are available such as behind-the-ear (BTE) hearing devices, hearing device with external earpiece (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. With these devices the damaged hearing is stimulated either mechanically or electrically.

The key components of hearing devices are principally an input transducer, an amplifier and an output transducer. The input transducer is normally a sound transducer e.g. a microphone and/or an electromagnetic receiver, e.g. an induction coil. The output transducer is most frequently realized as an electro-acoustic transducer (e.g. a miniature loudspeaker), or as an electromechanical transducer, (e.g. a bone conduction receiver). The amplifier is usually integrated into a signal processing unit. This basic configuration is illustrated in FIG. 1 using the example of a behind-the-ear hearing device. One or more microphones 2 for recording ambient sound are incorporated into a hearing device housing 1 to be worn behind the ear. A signal processing unit (SPU) 3 which is also integrated into the hearing device housing 1 processes and amplifies the microphone signals. The output signal from the signal processing unit 3 is transmitted to a loudspeaker or receiver 4, which outputs an acoustic signal. The sound may be transmitted to the device wearer's eardrum by way of an acoustic tube which is fixed in the auditory canal by means of an ear-mold. Power for the hearing device and in particular for the signal processing unit 3 is supplied by way of a battery (BAT) 5 which is also integrated in the hearing device housing 1.

Provided inside the housing in the majority of hearing devices is a receiver which generates the amplified sound for the hearing device wearer. The sound must be transmitted from the receiver out of the housing of the hearing device to the auditory canal of the hearing device wearer. Said transmission path requires a plurality of sound channels. Some of said sound channels are located within the housing, and some outside of the housing of the hearing device. Outside the hearing device housing, for example, one sound channel is located in the earhook of the hearing device, and one sound channel is located in the acoustic tube from the earhook to the auditory canal. Inside the hearing device housing, sound channels are located in the receiver connector from the receiver connector to an adapter to which the earhook is attached, and in the adapter itself.

In prior art devices, an acoustic tube having a specific minimum cross section is routed in the interior of the housing between the receiver connector and the adapter. Too small a cross section would cause the acoustic tube or pipe to have too strong a lowpass filter characteristic.

The pipe from the receiver to the adapter is generally routed through beneath a microphone and therefore mostly runs along the hearing device housing base, which has the greatest housing cross-sectional curvature. A corresponding amount of space must be provided for the pipe or the tube underneath the microphone.

SUMMARY OF THE INVENTION

It is accordingly an object of the invention to provide a hearing device which overcomes the above-mentioned disadvantages of the heretofore-known devices and methods of this general type and which provides for hearing device with a special sound channel and that reduces the space volume of a hearing apparatus and in particular of a hearing device.

With the foregoing and other objects in view there is provided, in accordance with the invention, a hearing apparatus, comprising:

a housing;

a receiver disposed in the housing;

a sound conductor configured for conducting sound originating from the receiver out of said housing; and a cover piece inserted into the housing and configured to form a sound channel between the receiver and the sound conductor. The sound channel is laterally delimited by the housing and the cover piece.

In other words, a cover piece is advantageously inserted into the housing of the hearing apparatus such that a sound channel is formed between the receiver and a sound conductor which is delimited at the sides by the housing and the cover piece. The housing is therefore used as a sound channel wall. This does mean however that all the space in the housing under the cover piece is used as a sound channel. The housing interior space is thus used more effectively, with no dead space remaining in the housing around a sound channel, and the housing can be made commensurately smaller.

In an embodiment, the housing can be approximately D-shaped in cross section and a housing segment with the greatest cross-sectional curvature can help form the sound channel. Said D-shaped cross section is typical in behind-the-ear hearing devices, since it is adapted to the anatomy of the outer ear. As a rule, no microphone can be installed in the area of the greatest cross-sectional curvature, so this area lends itself to use as the sound channel and can now be used completely because of the cover piece.

The cover piece preferably is substantially plate-shaped. This renders the cover piece both simple to manufacture and simultaneously suitable for use as a support for a microphone.

Moreover, the cover piece can have an opening as an inlet of the sound channel. This results in a defined opening of the sound channel which does not yet need to be taken into account during the housing injection molding process.

A connecting piece into which a receiver connector of the receiver is plugged can be formed on the cover piece around the opening of the sound channel. The cover piece can therefore additionally function as an adapter.

Furthermore, the sound conductor at the other end of the sound channel can be an adapter which forms an acoustic connection between a sound-conducting channel of an earhook attached to the housing and the sound channel in the housing. Here the adapter has the functionality both of conducting sound and serving for mechanical fastening.

Moreover, a microphone can be arranged in the housing, with the sound channel being routed through under the microphone. That means for example that the tip, i.e. the narrowest end of the hearing device housing, is optimally used in terms of space.

The sound channel can additionally be sealed in an air-tight manner by means of the cover piece with respect to the interior space of the housing. Feedback inside the housing can be avoided as a result. The cover piece can in particular be adhesively bonded or welded to the housing. Joining techniques of this type are especially suited to achieving an air-tight sound channel.

As has already been indicated above, it is particularly advantageous to embody the cited hearing apparatus as a behind-the-ear hearing device. The inventive technology allows smaller hearing devices to be built, thus raising their acceptance.

Other features which are considered as characteristic for the invention are set forth in the appended claims.

Although the invention is illustrated and described herein as embodied in a hearing apparatus having a special sound channel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
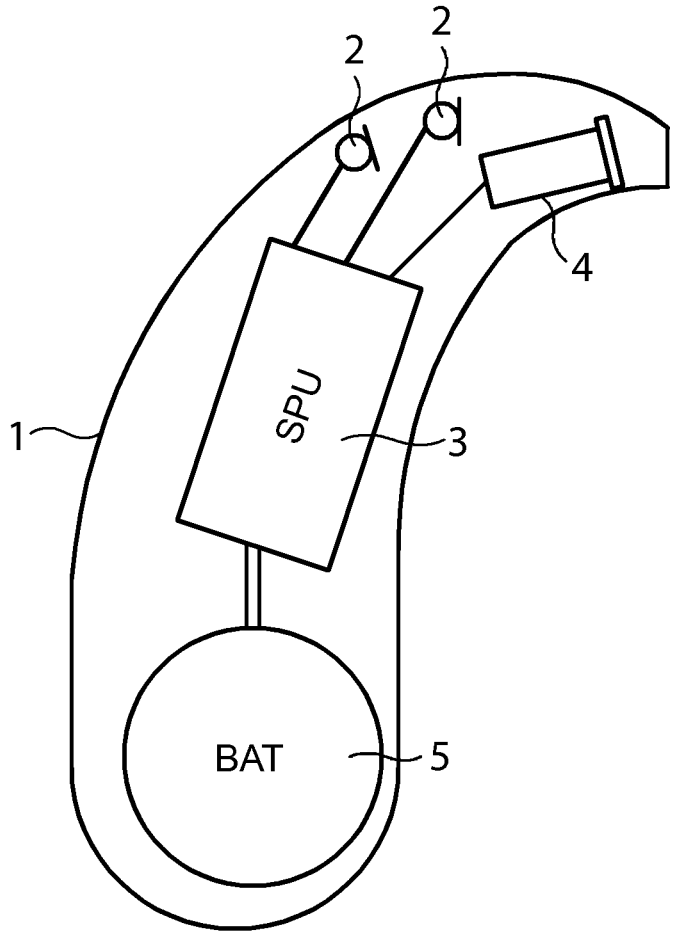
FIG. 1 PRIOR ART
FIG. 1 shows the basic design of a behind-the-ear hearing device according to the prior art.
Figure 2:
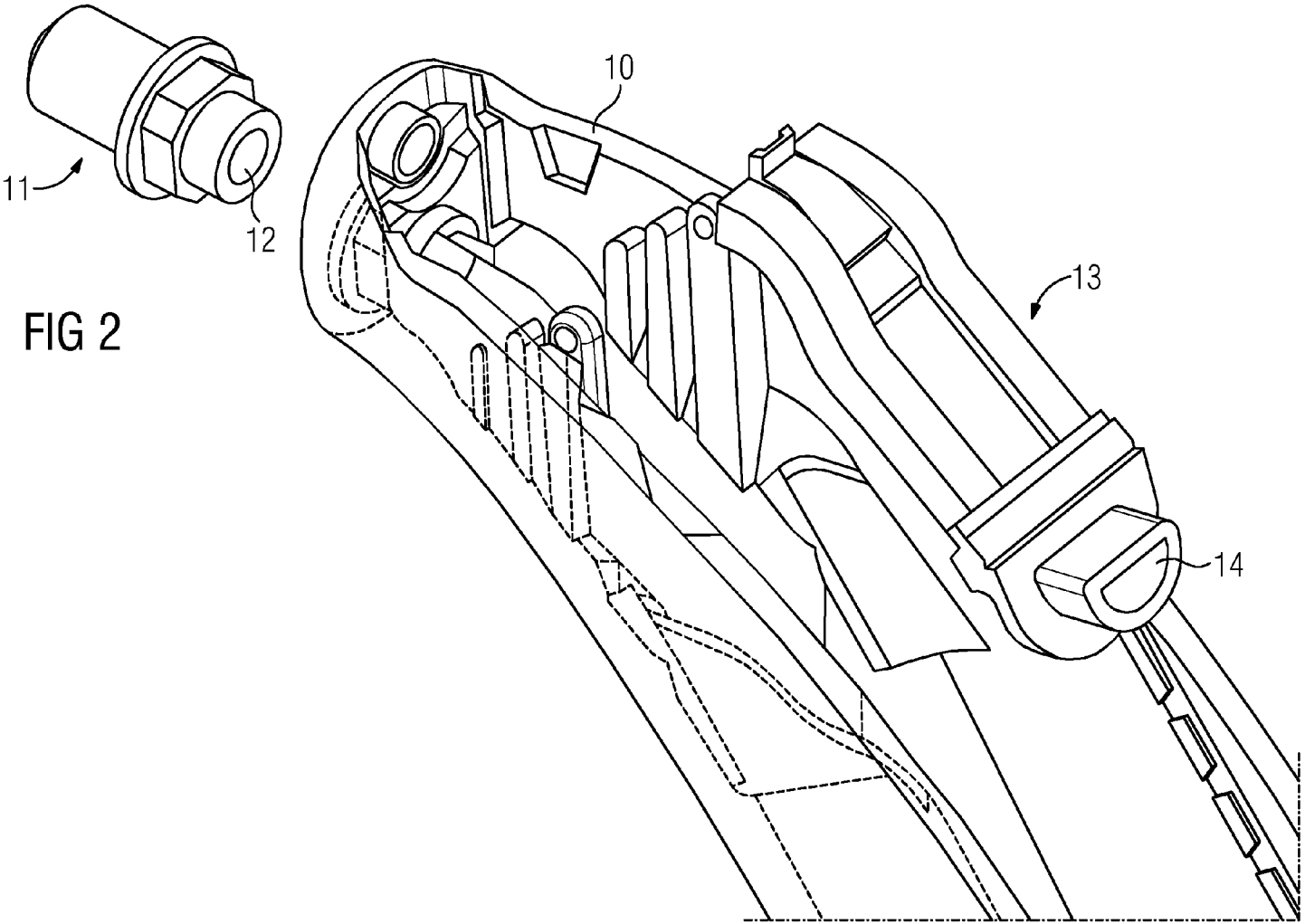
FIG. 2 is an exploded view of a front segment of a hearing device housing according to the invention.

Referring now once more to the figures of the drawing in detail, FIG. 2 illustrates a segment of a housing 10 for a BTE hearing device. For the purposes of illustration, the housing 10 is drawn open toward the top. An adapter 11 which serves as a sound conductor can be inserted into the front side of the housing 10 in order to conduct the sound generated in the housing to the outside. The adapter has a corresponding hole 12 for this purpose.

FIG. 2 also shows a cover piece 13 which can be inserted into the housing 10. The cover piece 13 has approximately the shape of an elongate plate. Provided at one end is a connecting piece 14 through which the sound to be conducted to the outside can be conveyed. A connecting face 15 is located at the other end of the cover piece 13 to establish a soundproof connection to the adapter 11 (cf. FIG. 3).

In cross section, the housing 10 has a form approaching a D shape. Here, the lower segment 16 of the housing has a significantly greater curvature than the upper segment 17. When the device is worn behind the ear, the lower segment 16 faces downward and lies in the gap between pinna and cranial bone. Since the interior space in the housing 10 in the region of the lower segment 16 is very narrow, it cannot be used for conventional signal processing components such as microphones, receivers or amplifiers. According to the invention, no acoustic tubes are inserted into the space in the region of the lower segment 16 either, but rather the entire space is used as a sound channel. This space is delimited toward the top by the cover piece 13.

Figure 3:
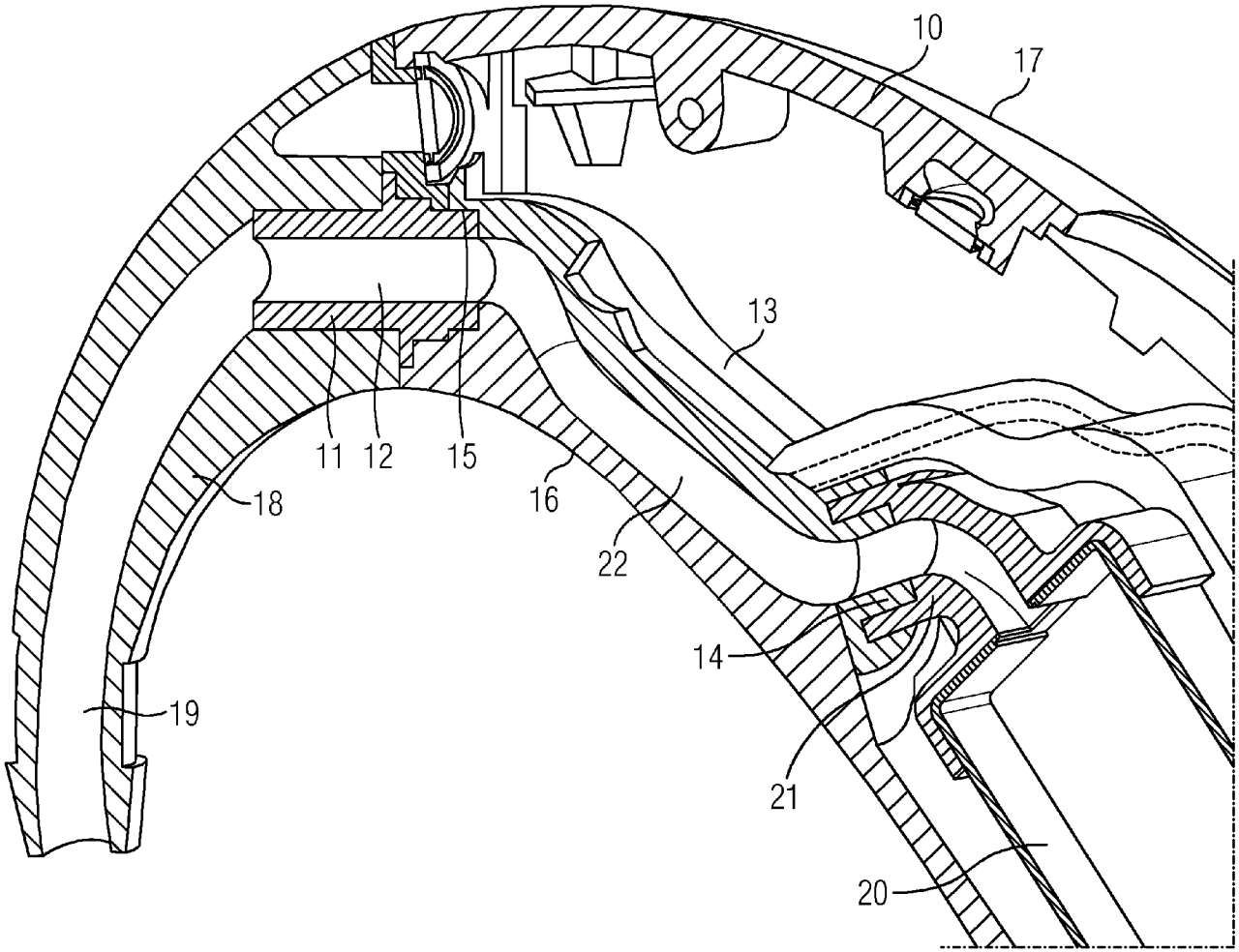
FIG. 3 shows a longitudinal section through the forward segment of a hearing device.

FIG. 3 shows the front segment of the BTE hearing device in longitudinal section in the almost fully assembled state. The adapter 11 is inserted into the housing 10. Mounted onto the adapter 11 is an earhook 18 which itself has a sound channel 19 from the adapter to its tip.

Additionally a receiver 20 which generates the amplified sound is inserted into the housing 10. At its outlet it has a receiver connector 21 through which its output sound is conducted.

Also shown in FIG. 3 is the cover piece 13 in its final assembly position. A sound channel 22 is formed between the housing inner wall in the region of the lower segment 16 and the cover piece 13. The sound channel 22 extends over the whole width within the housing underneath the cover piece 13.

The receiver connector 21 is mounted onto the connecting piece 14 of the cover piece 13. The connecting face 15 of the cover piece 13 is connected to the adapter 11 on the earhook side. This results in the sound channel 22 being formed under the cover piece 13. Overall, this results in a soundproof conducting of the sound from the receiver 20 through the receiver connector 21, the sound channel 22, the channel 12 in the adapter 11 and the channel 19 in the earhook 18.

In the present example, therefore, an, in the present case D-shaped, sound channel is obtained inside the housing 10 instead of an acoustic pipe or acoustic tube (round or rectangular cross section). In order to realize this sound channel 22, only the cover piece 13 must then be inserted into the housing 10 using ultrasonic welding or adhesive bonding. Overall, for an identical channel cross section, this leads to better utilization of the space in the hearing device housing, so that the housing 10 or the hearing device as a whole can be made smaller.

In the present example the cover piece 13 is embodied as plate-shaped. In principle however it can also assume any other shape in order to form the wall of the sound channel 22. Moreover the cover piece 13 can fulfill a further function, namely that of a mount for a microphone of the hearing device. For clarity of illustration, a microphone of this type is not shown in FIG. 3, but can be placed in the space above the cover piece 13.

The invention claimed is:

1. A behind-the-ear (BTE) hearing apparatus, comprising:

a BTE housing to be worn behind the ear, said housing having an exterior wall;

a receiver disposed in said housing;

a sound conductor configured for conducting sound originating from said receiver out of said housing; and a cover piece inserted into said housing and disposed in vicinity of said exterior wall of said housing to form a sound channel, together with said exterior wall, extending from said receiver to said sound conductor for conducting sound from said receiver out of said housing.

2. The hearing apparatus according to claim 1, wherein said housing is substantially D-shaped in cross section and a housing segment having a greatest cross-sectional curvature forms a part of said sound channel.

3. The hearing apparatus according to claim 1, wherein said cover piece is substantially plate-shaped.

4. The hearing apparatus according to claim 1, wherein said cover piece is formed with an opening forming an inlet of said sound channel.

5. The hearing apparatus according to claim 4, which comprises a connecting piece formed around said opening of said cover piece, and a receiver connector of said receiver mounted onto said connecting piece.

6. The hearing apparatus according to claim 1, wherein said sound conductor is an adapter configured to form an acoustic connection between a sound-conducting channel of an earhook attached to said housing and said sound channel in said housing.

7. The hearing apparatus according to claim 1, which comprises a microphone disposed in said housing, and wherein said sound channel is routed through underneath said microphone.

8. The hearing apparatus according to claim 1, wherein said sound channel is sealed air-tight by way of said cover piece with respect to an interior space of said housing.

9. The hearing apparatus according to claim 1, wherein said cover piece is adhesively bonded or welded to said housing.

* * * * *